United States Patent [19]

Simon

[11] 4,299,547

[45] Nov. 10, 1981

[54] ROTARY FUEL INJECTION PUMP WITH TWO COMPRESSION OPENINGS

[75] Inventor: Helmut Simon, Göppingen, Fed. Rep. of Germany

[73] Assignee: Robert Bosch GmbH, Stuttgart, Fed. Rep. of Germany

[21] Appl. No.: 63,598

[22] Filed: Aug. 6, 1979

[30] Foreign Application Priority Data

Nov. 11, 1978 [DE] Fed. Rep. of Germany ..... 2849012

[51] Int. Cl.[3] ..... F04C 2/00; F04C 13/00; F04C 15/02

[52] U.S. Cl. ..... 418/15

[58] Field of Search ..... 418/15, 189, 259

[56] References Cited

U.S. PATENT DOCUMENTS

| | | | |
|---|---|---|---|
| 2,778,317 | 1/1957 | Cockburn | 418/189 |
| 2,832,199 | 4/1958 | Adams et al. | 418/15 |
| 2,948,229 | 8/1960 | Brundage | 418/15 |
| 3,072,067 | 1/1963 | Beller | 418/189 |
| 3,267,862 | 8/1966 | Mosbacher | 418/15 |

*Primary Examiner*—John J. Vrablik

*Attorney, Agent, or Firm*—Edwin E. Greigg

[57] ABSTRACT

An injection device is proposed for internal combustion engines whose vane cell pump has two channels 23, 22. Each channel begins at the end portion of the compression recess 21 and discharges into the congruent openings 24, 25 of the support ring 17 and of the receiving ring 16, respectively. These openings are embodied as grooves and are disposed near the rotary wall 28 of the housing 10 of the injection device.

4 Claims, 2 Drawing Figures

ROTARY FUEL INJECTION PUMP WITH TWO COMPRESSION OPENINGS

BACKGROUND OF THE INVENTION

In known distributor-injection devices, the rotary pump which constantly fills the interior of the housing with fuel is embodied as a vane cell pump. An opening which connects the compression recess of the pump with the housing interior penetrates a receiving ring and a support ring in the axial direction and is disposed approximately in the center of the compression recess. Cavitation has been found in such devices particularly after long periods of operation, which can be traced back to the occurrence of underpressure.

As is shown on a chart of "Bosch Distributor-Type Fuel Injection Pump VA" (training chart VDT-U 2/304 En), copyright 1971, a roller ring is a supporting element of the rollers which bring about, among other things, the axial motion of the distributor piston in interaction with a cam plate. As explained in the description in the specification of the application, cavitation damages were noted in the area of the only axially directioned rupture in known injection devices which can be certainly traced to cavitation. This is explained in that the roller ring impacted or attacked by the pressure liquid starts to vibrate and this vibration causes the cavitation damages in conjunction with the pressure liquid in the inner chamber.

OBJECT AND SUMMARY OF THE INVENTION

The cavitation which has been noted in the prior art devices is prevented with the injection device for engines in accordance with the present invention. The fundamental object of the invention is to provide two openings for the fuel flow into the housing interior rather than one opening, which is normally used.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 2:
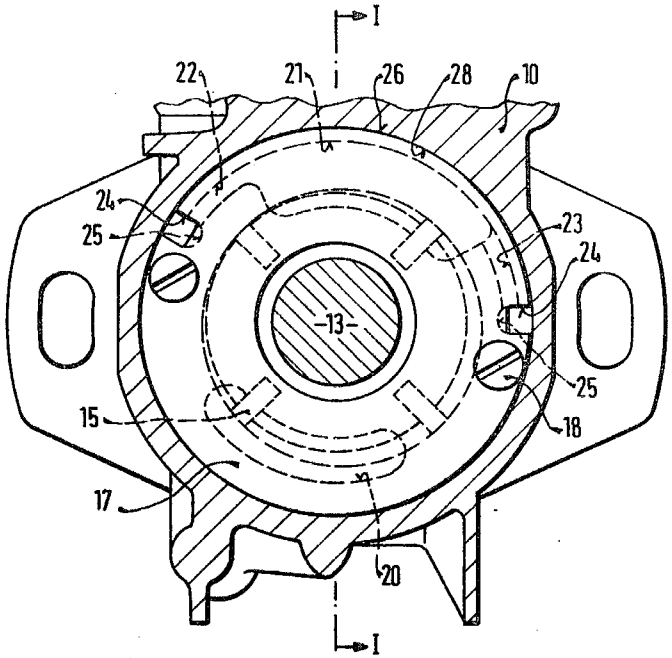
FIG. 2 is a cross-sectional view taken along the line II—II of FIG. 1.
Figure 1:
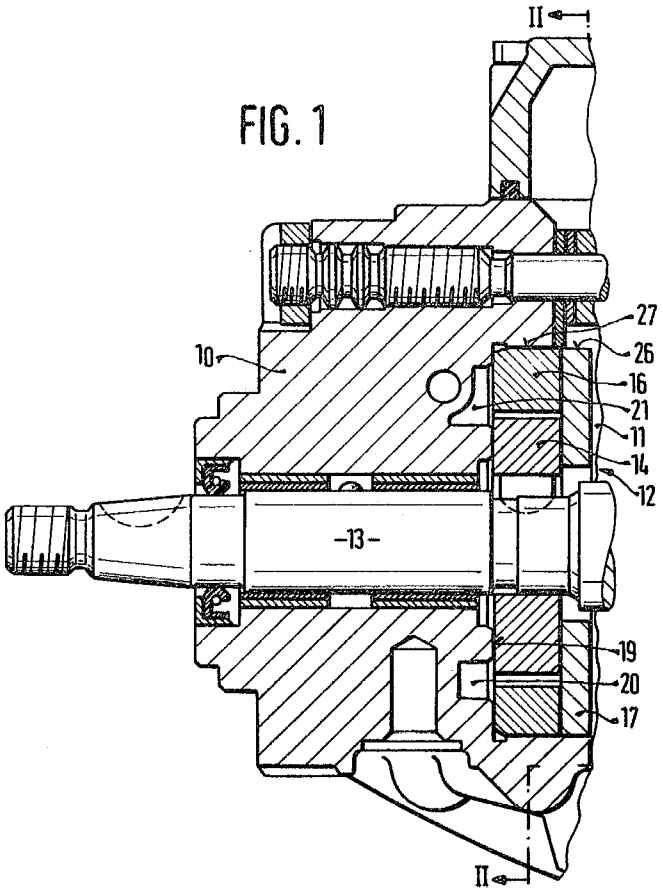
FIG. 1 is a fragmentary cross-sectional view through a distributor-injection device.

Turning now to the drawing, the injection device for internal combustion engines shown in FIGS. 1 and 2 and embodied as a so-called distributor-injection supply pump has a housing 10, whose interior 11 is the suction chamber for a high-pressure pumping circuit (not shown). A rotary pump 12 embodied as a vane cell pump substantially comprises, first, a grooved rotor disc 14 which has four vanes 15 in all and is coupled in a force-locking manner with a drive shaft 13, and, second, a receiving ring 16 which cooperates with the vanes 15. A support ring 17 securely holds the receiving ring 16 in proper position by means of two screws 18, which are arranged as shown in FIG. 2, on the lateral wall 19 of the housing 10.

One intake recess 20 and, opposite thereto, one compression recess 21 are provided in the lateral wall 19. At each of the two end portions of the compression recess 21, there is disposed an adjacent channel 22 and 23, respectively, of U-shaped cross-section, each of which extends as far as the vicinity of the insertion hole, not shown, for the screw 18. The cavitation is avoided with use of two channels 22 and 23 because as a result of them the apertures 24 and 25 are disposed in areas remote from a roller ring (not shown).

The support ring 17 and the receiving ring 16 have two openings 24 and 25 each, which are embodied as grooves with the groove openings oriented toward the external surface 26, 27 of the two rings and toward the rotary housing wall 28 of the housing 10. The cooperating openings 24 and 25 are substantially congruent and communicate in turn with the channel 22 or 23, with the two groove-like openings 24, 25 of the two rings 17 or 16 being disposed near the screws 18.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. An injection device for internal combustion engines comprising a rotary pump for the supply of fuel into an inner chamber of a housing a grooved rotor disc included in said rotary pump and it having a plurality of vanes coupled in force-locking relation with a drive shaft, an intake recess on one side of said grooved rotor disc toward a rotary housing wall of said housing, a compression recess in the rotary pump being provided in a lateral wall in said housing which communicates through openings with the interior thereof, said openings being disposed remotely from each other, a ring member in said housing having said openings in said ring member, said compression recess communicating with oppositely extending channels, each of said channels being arranged to discharge into one of said openings, said ring member abutting an annular element provided with openings arranged to communicate with said openings in said ring member, said inner chamber receiving pressure medium guided therein from said two openings being disposed remotely from each other to substantially reduce and eliminate cavitation in the injection pump.

2. An injection device for internal combustion engines of claim 1, wherein said ring member is in abutting relation with said annular element, and said annular element encompasses said grooved rotor disc.

3. An injection device for internal combustion engines of claim 1, wherein said ring member and said annular element include peripheral surface areas and sad openings are correlated in each of said surface areas.

4. An injection device for internal combustion engines of claim 1, wherein said ring member and said annular element are secured to said housing by means of diametrically opposed screw elements and said openings in said ring member and said annular element are in proximity to one each of said screw elements.

* * * * *